US008376579B2

(12) United States Patent
Chang

(10) Patent No.: US 8,376,579 B2
(45) Date of Patent: Feb. 19, 2013

(54) LED LAMP

(75) Inventor: Shao-Han Chang, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 195 days.

(21) Appl. No.: 13/048,875

(22) Filed: Mar. 16, 2011

(65) Prior Publication Data

US 2012/0075850 A1 Mar. 29, 2012

(30) Foreign Application Priority Data

Sep. 27, 2010 (CN) ..... 2010 1 0293294

(51) Int. Cl.
*F21S 4/00* (2006.01)
*F21V 21/00* (2006.01)

(52) U.S. Cl. ..... 362/249.02; 362/218; 362/224; 362/225; 362/311.02; 362/800

(58) Field of Classification Search ..... 362/218, 362/223–225, 249.02, 311.02, 800
See application file for complete search history.

(56) References Cited

FOREIGN PATENT DOCUMENTS

| | | | |
|---|---|---|---|
| CN | 201034306 | Y | 3/2008 |
| CN | 201078687 | Y | 6/2008 |
| CN | 201382283 | Y | 1/2010 |
| TW | M345953 | | 12/2008 |
| TW | M376787 | | 3/2010 |

*Primary Examiner* — Jason Moon Han
(74) *Attorney, Agent, or Firm* — Altis Law Group, Inc.

(57) ABSTRACT

An LED lamp includes a base, an encapsulation, a substrate and a light distribution board. A number of light emitting diodes are mounted on the substrate. The encapsulation, the substrate and the light distribution board are all fixed to the base. Opposite sides of the light distribution board respectively face the encapsulation and the substrate. The light distribution board includes a number of protrusions. The protrusions totally reflect the incident light beams from the light emitting diodes perpendicular to or substantially perpendicular to the light distribution board.

7 Claims, 5 Drawing Sheets

LED LAMP

BACKGROUND

1. Technical Field

The present disclosure relates to illumination devices, especially to an LED lamp.

2. Description of Related Art

Compared to traditional light sources, light emitting diodes (LEDs) have many advantages, such as high luminous efficiency, low power consumption, and long service life. LED lights are widely used in many applications. The light emitting diodes are small and have a narrow light emitting angle, thus the light emitting diodes emit light that may be too bright, which may negatively impact people's eyes.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Figure 1:
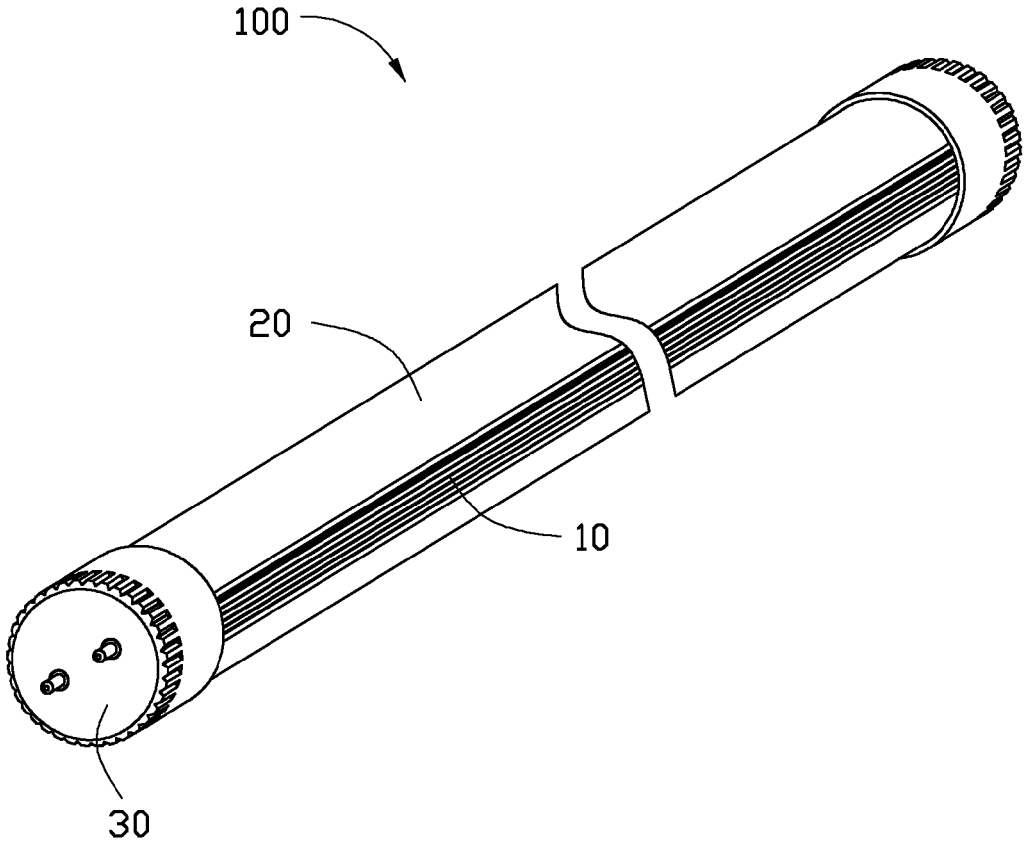
FIG. 1 is an isometric view of an LED lamp according to an exemplary embodiment.
Figure 2:
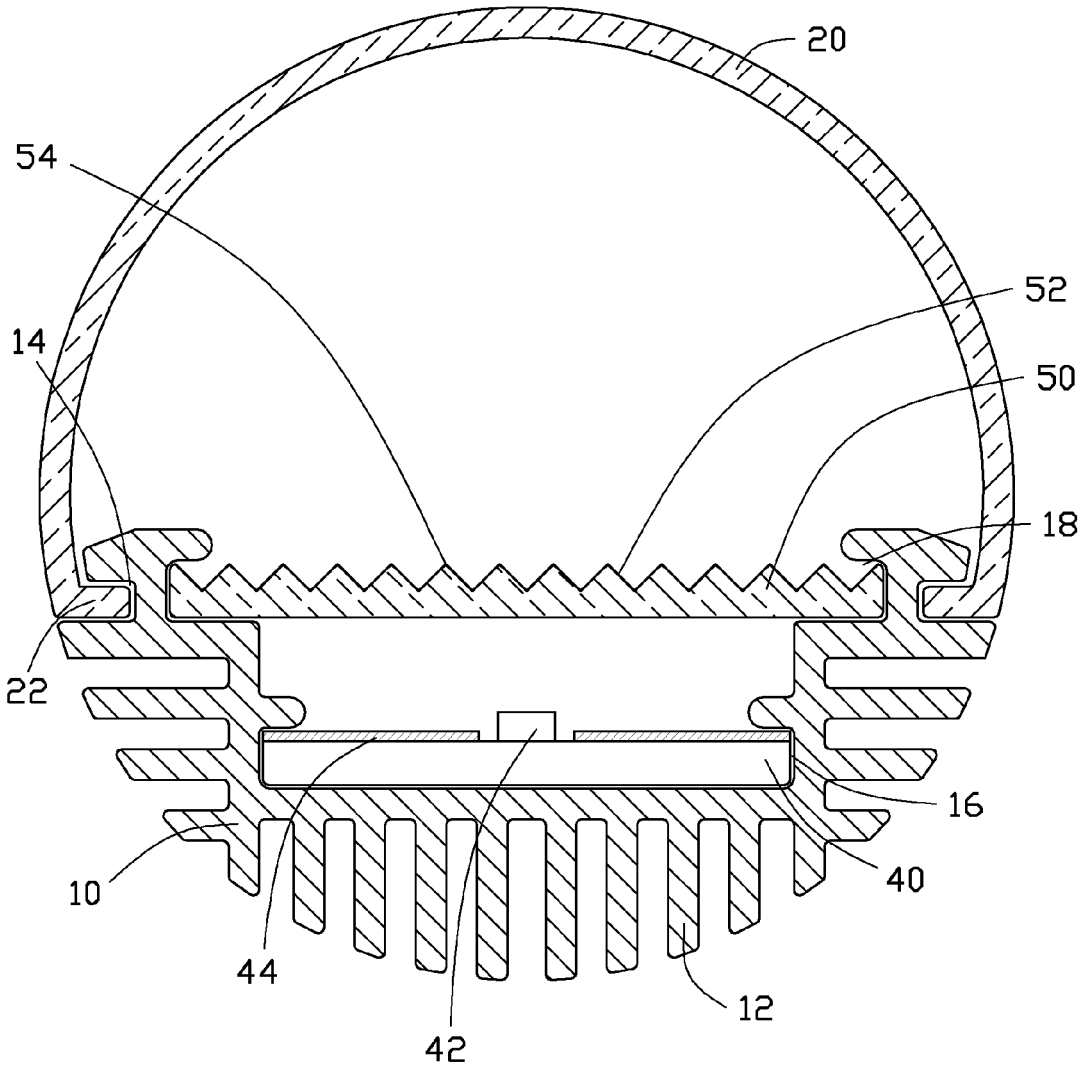
FIG. 2 is a cross-sectional view of the LED lamp in FIG. 1.

Referring to FIGS. 1 and 2, an LED lamp 100 according to an exemplary embodiment includes a base 10, a encapsulation 20, a pair of power connectors 30, a substrate 40, and a light distribution board 50. The encapsulation 20, the substrate 40 and the light distribution board 50 are all fixed to the base 10. The pair of power connectors 30 are respectively fixed to two ends of the encapsulation 20 and used to connect with a counter power connector (not shown), such that power can be supplied to the LED lamp 100. The substrate 40 is electrically connected to the power connectors 30. A number of light emitting diodes 42 are mounted on the substrate 40. The light distribution board 50 is configured for changing the direction of light beams from the emitting diodes 42.

The base 10 can be made of aluminum alloy with excellent thermal diffusivity and used for dispersing heat generated by the LED lamp 100 at work. The bottom of the base 10 includes a plurality of heat sinks 12 at intervals. The heat sinks 12 are configured for increasing surface area of the base 10 to accelerate air ventilation. Each of opposite ends of the base 10 defines an indentation 14. Each of opposite ends of the encapsulation 20 includes a latch 22 extending toward each other. The pair of latches 22 are respectively received in the pair of indentations 14, to fix the encapsulation 20 to the base 10. The base 10 defines a first receiving groove 16 adjacent to the encapsulation 20 and a second receiving groove 18 away from the encapsulation 20.

The substrate 40 is received in the first receiving groove 16 and affixed to the base 10 by a heat conducting adhesive. The heat conducting adhesive is used for conducting heat generated by the substrate 40 to the base 10 effectively. The substrate 40 surface, where the light emitting diodes 42 are positioned, is coated with a reflective layer 44.

The light distribution board 50 is received in the second receiving groove 18. Opposite sides of the light distribution board 50 respectively face the substrate 40 and the encapsulation 20. The light distribution board 50 includes a number of protrusions 52 facing the encapsulation 20. In the embodiment, the protrusions 20 can be serrated. The cross section of each protrusion 52 is an approximate isosceles triangle. The angle of peak 54 of each protrusion 52 falls within a preset range, such that the protrusions 52 totally reflect the incident light beams emitted from the light emitting diodes 42 perpendicular to or substantially perpendicular to the light distribution board 50.

Figure 3:
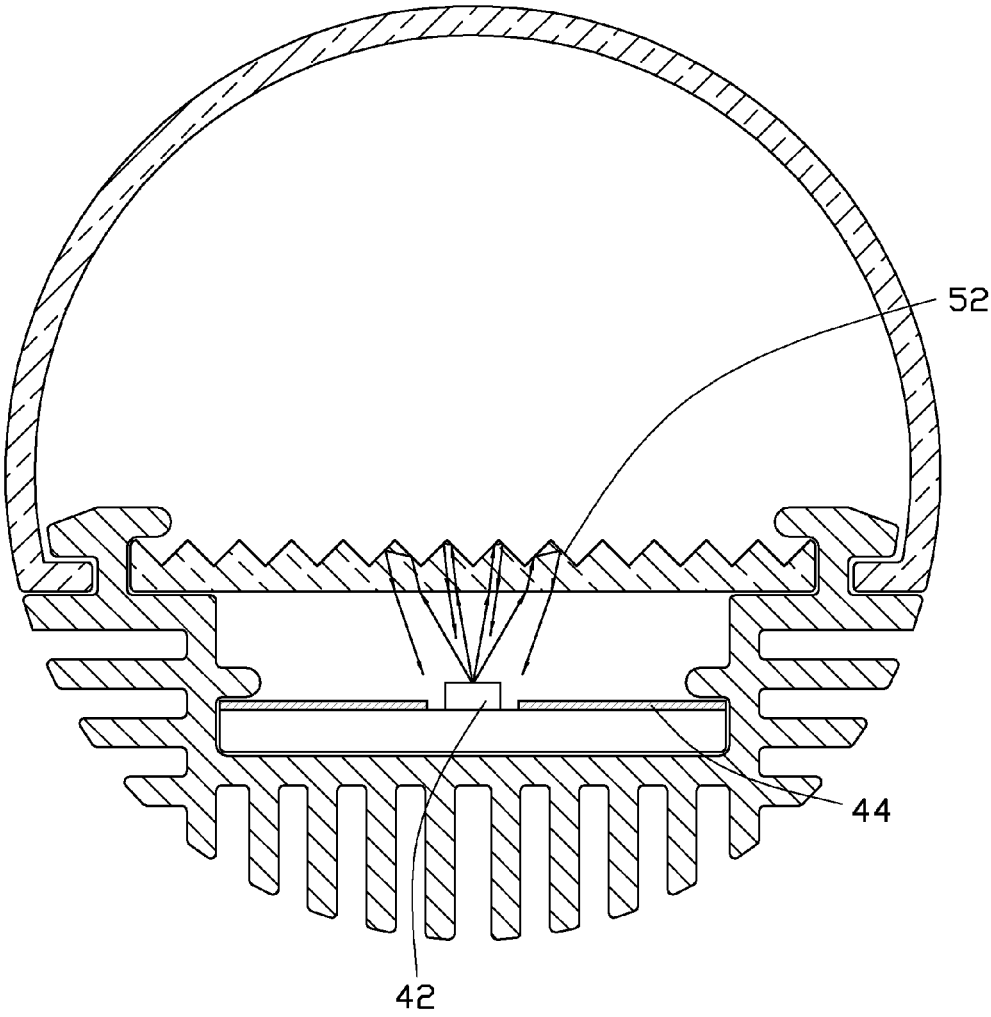
FIG. 3 is a schematic view of light paths illustrating light beams emitted from light emitting diodes in a forward direction in FIG. 2.

Referring to FIG. 3, the light beams emitted from the light emitting diodes 42 perpendicular to or substantially perpendicular to the light distribution board 50 enter the center protrusions 52 and are totally reflected to the reflecting layer 44 by the center protrusions 52. Then the reflecting layer 44 reflects the light beams to the surrounding protrusions 52, in this way, the incident angle of the light beams decreases. After one or more times totally reflecting, the incident angle of the light beams are less than a critical value and the light beams are refracted to the encapsulation 20 by the surrounding protrusions 52. Therefore, with the light distribution board 50, the light beams emitted from the light emitting diodes 42 perpendicular to or substantially perpendicular to the light distribution board 50 are partially reflected and are refracted to the surrounding protrusions 52. The center light beams are dispersed to reach a better distributed illumination.

Figure 4:
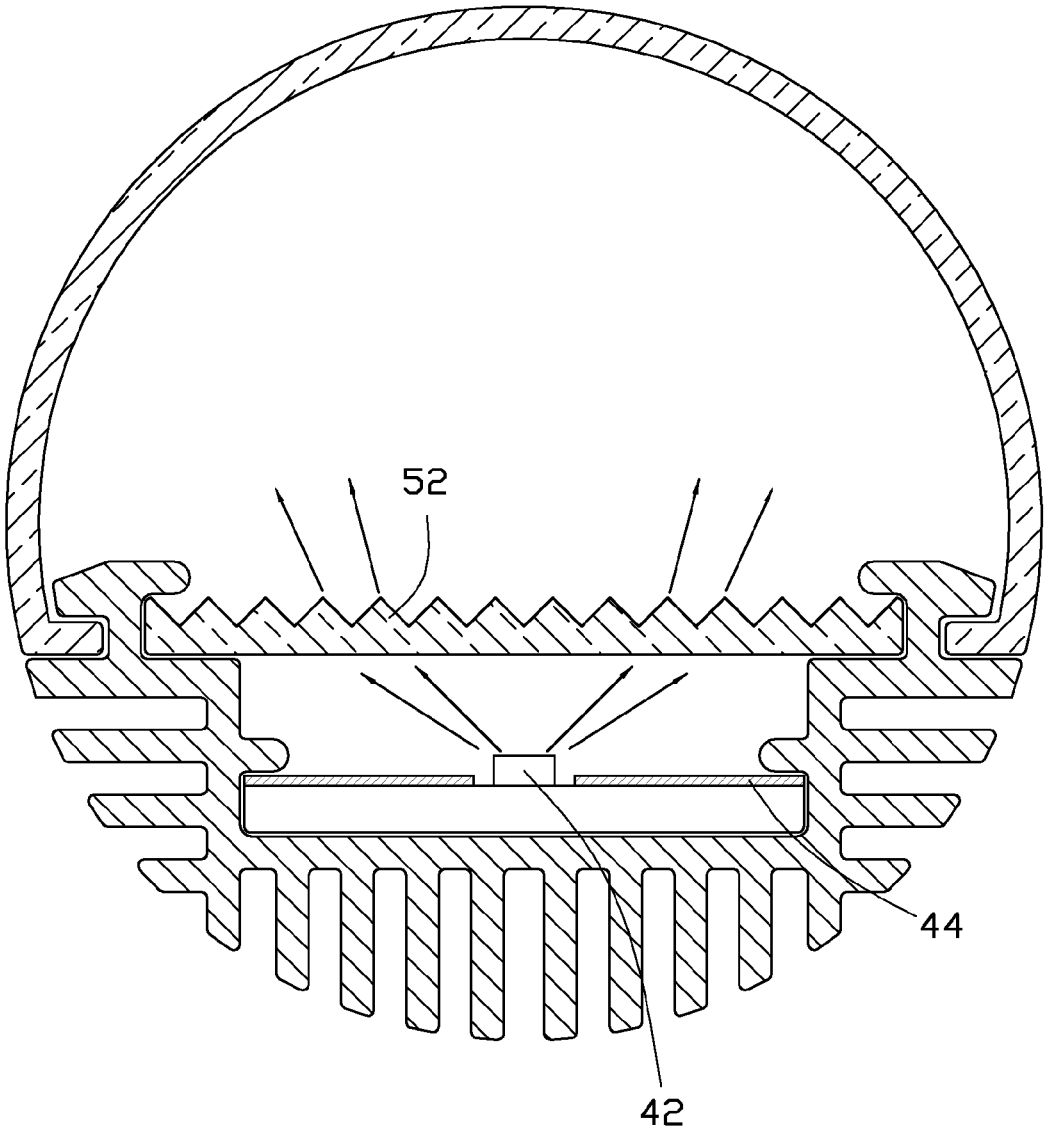
FIG. 4 is a schematic view of light paths illustrating light beams emitted from light emitting diodes in an oblique direction in FIG. 2.

Referring to FIG. 4, the light beams emitted from the light emitting diodes 42 in an oblique direction are refracted by the protrusions 52. The emitting angle of the light beams is thus narrower. Therefore, the surrounding light beams density is close to the center light beams density to reach a better distributed illumination.

Figure 5:
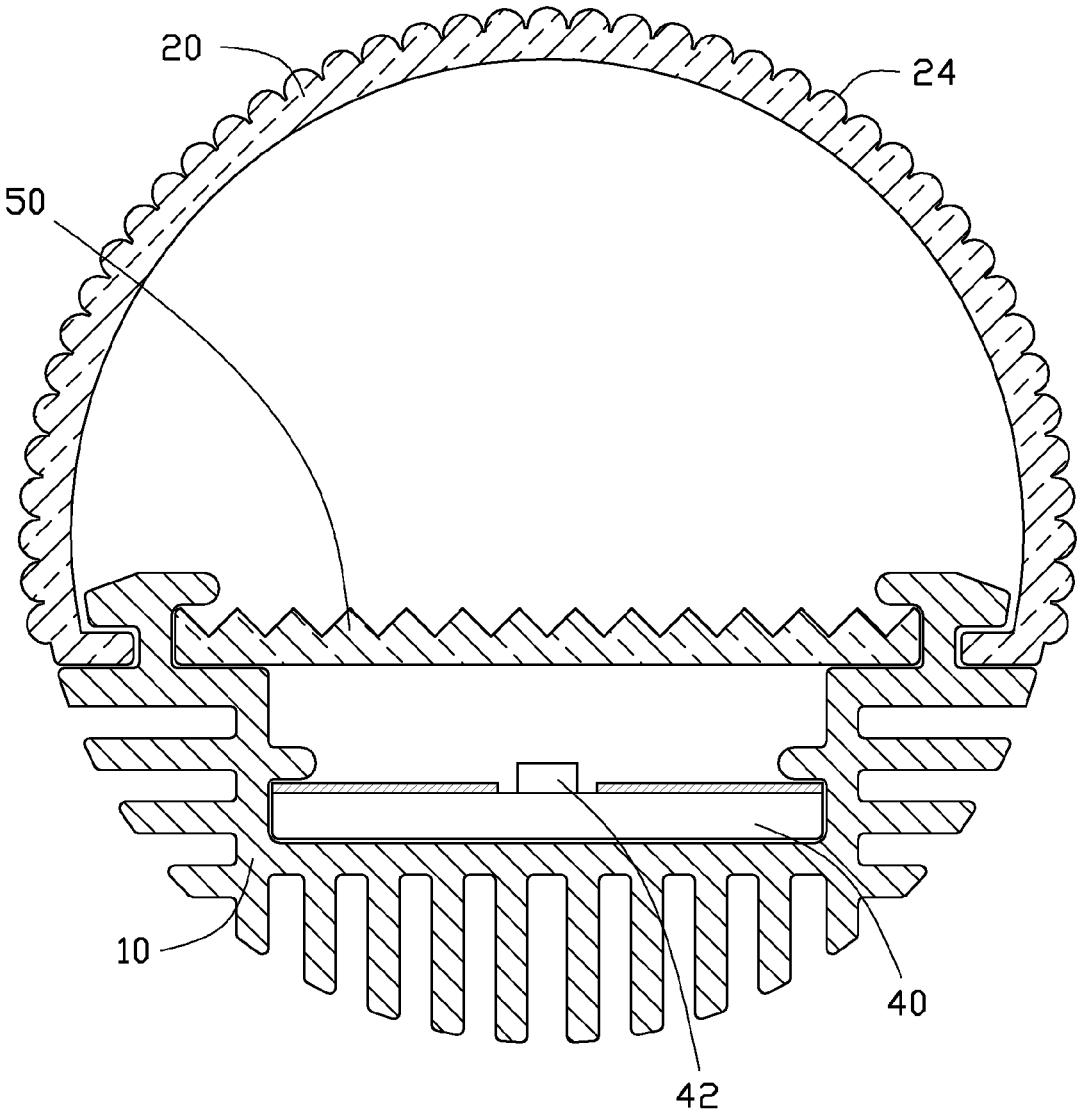
FIG. 5 is a cross-sectional view of the LED lamp in FIG. 1 according to another exemplary embodiment.

Referring to FIG. 5, in another embodiment, the outside surface of the encapsulation 20 includes an arc lens array 24. The light beams, which enter the encapsulation 20 are scattered by the lens array 24. The light emitting angle of the light emitting diodes 42 enlarges, so that the light beams become softer. In an alternative embodiment, the arc lens array 24 may be formed in the inner surface of the encapsulation 20.

It is to be understood, however, that even though numerous characteristics and advantages of the present disclosure have been set forth in the foregoing description, together with details of the structure and function of the present disclosure, the present disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. A cylindrical LED lamp comprising:

a base;

a tubular encapsulation a substrate; and a light distribution board;

wherein a plurality of light emitting diodes are mounted on the substrate; the encapsulation, the substrate and the light distribution board are all individually fixed to the base opposite sides of the light distribution board respectively face the encapsulation and the substrate; the light distribution board comprises a plurality of serrated protrusions; the protrusions are configured for totally reflecting the incident light beams from the light emitting diodes perpendicular to or substantially perpendicular to the light distribution board.

2. The LED lamp of claim 1, wherein the outside surface of the encapsulation includes an arc lens array.

3. The LED lamp of claim 1, wherein the inner surface of the encapsulation includes an arc lens array.

4. The LED lamp of claim 1, wherein a surface of the substrate where the light emitting diodes are positioned is coated with a reflecting layer.

5. The LED lamp of claim 1, wherein each of the opposite ends of the base defines an indentation, each of the opposite ends of the encapsulation comprises a latch extending toward each other, the pair of latches are respectively received in the pair of indentations to fix the encapsulation to the base.

6. The LED lamp of claim 1, wherein the base comprises a plurality of heat sinks at intervals.

7. The LED lamp of claim 1, wherein the base defines a first receiving groove adjacent to the encapsulation and a second receiving groove away from the encapsulation, the substrate is received in the first receiving groove, the light distribution board is received in the second receiving groove.

* * * * *